US008819900B2

(12) United States Patent
Aldoihi

(10) Patent No.: US 8,819,900 B2
(45) Date of Patent: Sep. 2, 2014

(54) MAGNETIC ORGANIZING AND ATTACHMENT DEVICE

(76) Inventor: Saad Abdulla Aldoihi, Auburn Hills, MI (US)

( * ) Notice: Subject to any disclaimer, the term of this patent is extended or adjusted under 35 U.S.C. 154(b) by 266 days.

(21) Appl. No.: 13/463,838

(22) Filed: May 4, 2012

(65) Prior Publication Data

US 2013/0291348 A1 Nov. 7, 2013

(51) Int. Cl.
*B42D 9/00* (2006.01)

(52) U.S. Cl.
USPC ..... 24/303; 116/234; 116/240; 281/42

(58) Field of Classification Search
USPC ..... 24/303; 116/234, 240; 281/42, 50; 402/503, 4; 40/661.01
See application file for complete search history.

(56) References Cited

U.S. PATENT DOCUMENTS

| | | | | | |
|---|---|---|---|---|---|
| 2,448,611 | A * | 9/1948 | Martin | 116/234 |
| 3,111,736 | A | 11/1963 | Budreck | |
| 3,697,100 | A * | 10/1972 | Hawkins | 281/42 |
| 3,898,951 | A * | 8/1975 | Clare | 116/239 |
| 5,050,276 | A | 9/1991 | Pemberton | |
| 5,103,756 | A * | 4/1992 | Korkames | 116/234 |
| 5,682,653 | A * | 11/1997 | Berglof et al. | 24/303 |
| 5,876,145 | A * | 3/1999 | Datum | 402/4 |
| 6,401,649 | B1 * | 6/2002 | Smith | 116/234 |
| 6,412,116 | B1 * | 7/2002 | Clark | 2/129 |
| 7,320,156 | B1 | 1/2008 | Slayton | |
| 7,325,349 | B2 | 2/2008 | Becker | |
| 7,673,410 | B1 | 3/2010 | Buerchner et al. | |
| 7,721,392 | B2 | 5/2010 | Avery | |
| 8,448,595 | B2 * | 5/2013 | Cook-Thalacker | 116/234 |
| 2002/0096103 | A1 * | 7/2002 | Capstran | 116/234 |
| 2006/0172103 | A1 * | 8/2006 | Chang | 428/40.1 |
| 2011/0315069 | A1 * | 12/2011 | Thalacker | 116/234 |

* cited by examiner

*Primary Examiner* — Robert J Sandy
*Assistant Examiner* — Rowland Do
(74) *Attorney, Agent, or Firm* — Oblon, Spivak, McClelland, Maier & Neustadt, L.L.P.

(57) ABSTRACT

An organization and attachment device for detachably holding an insert. The device includes a first section with a first magnet section, a second section with a second magnet section, and a connecting section joining the first section and second section. The device also includes a linking device engaged with the connecting section. The linking device includes a linking member with a first end and a second end, and a first fastener connected to one of the ends of the linking member. The holding device can be arranged in multiple positions in which the linking device is stored. In each position in which the linking device is stored, the linking device is held in place by at least one of the magnet sections. In one position in which the linking device is stored, the linking device is completely enclosed by the first and second magnet sections.

20 Claims, 10 Drawing Sheets

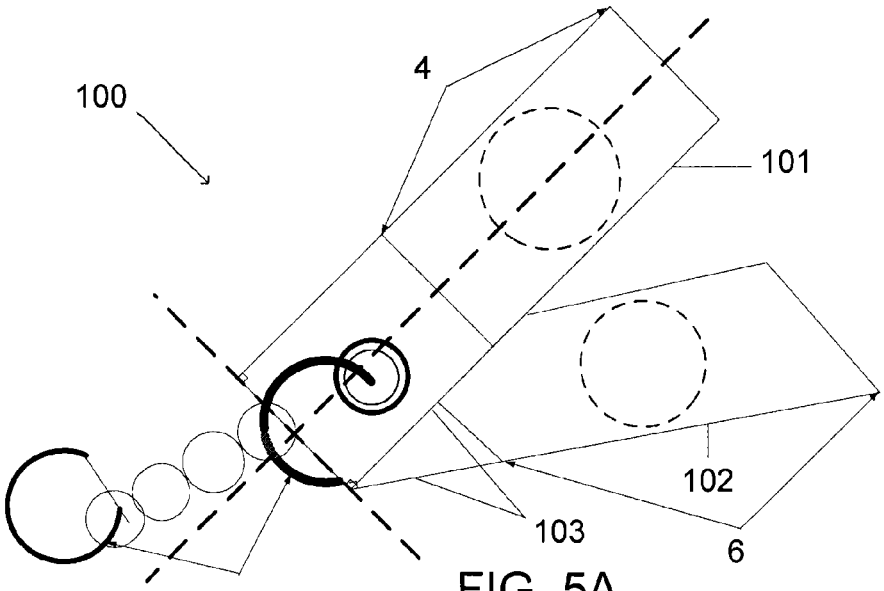
FIG. 5A
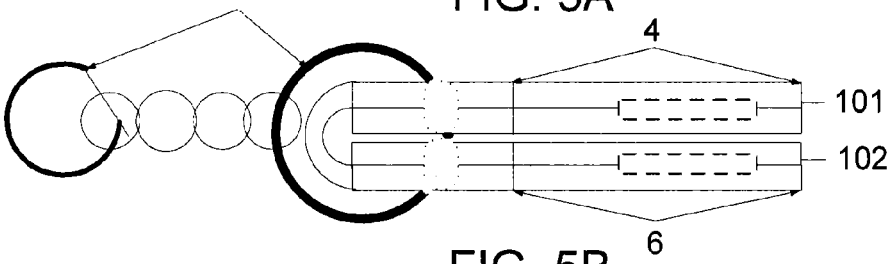
FIG. 5B
FIG. 5C
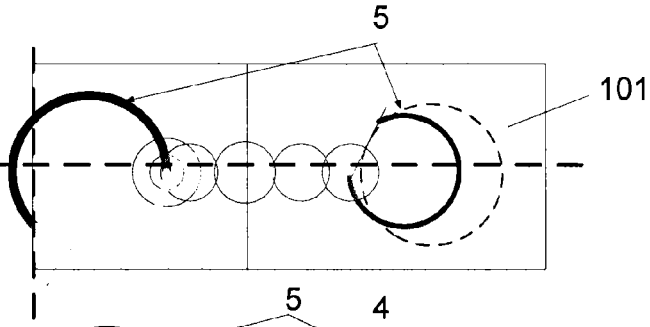
FIG. 5D
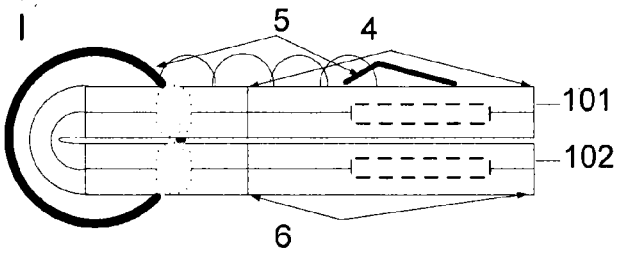
FIG. 5E
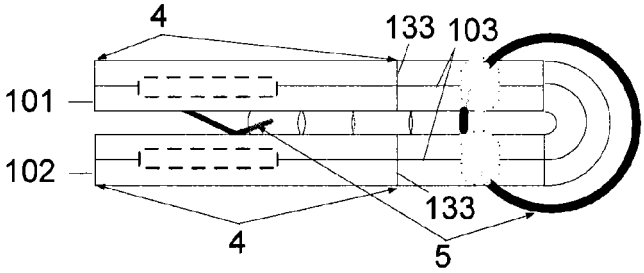

MAGNETIC ORGANIZING AND ATTACHMENT DEVICE

GRANT OF NON-EXCLUSIVE RIGHT

This application was prepared with financial support from the Saudia Arabian Cultural Mission, and in consideration therefore the present inventor(s) has granted The Kingdom of Saudi Arabia a non-exclusive right to practice the present invention.

FIELD OF THE DISCLOSURE

The present invention is related to devices for organizing items such as loose paper or groups of sheets of paper together.

DESCRIPTION OF THE RELATED ART

It is often the case in academic environments such as classrooms or laboratories, or professional environments such as conferences or business meetings, that an attending individual brings paper documents in a notebook or binder to take notes or inform the individual of the subject matter of the event as it occurs. It is also often the case that in these situations, information is distributed to individuals in the form of paper documents that are pertinent to notes written on a page in the notebook or information in a page of the binder.

Devices for holding papers may include, for example, staples, paper clips, and the like. However these devices have several disadvantages. Staples, for example, may damage the documents and not be able to bind a large number of documents together. Staples also have the disadvantage that they must be deformed to be removed and are not reusable. Paper clips are easily deformed and the number of sheets they can group together is limited. In addition when multiple documents of the type previously discussed are distributed, it is difficult to group them together with a staple or a paper clip, while at the same time physically associating them with the relevant page in the notebook or binder.

Thus, there exists a need for a holding device that is able to group document sheets together while attaching them (or a single sheet) to a page in a notebook with information that is relevant to the subject matter of the document sheet(s).

The foregoing "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

SUMMARY

The present invention describes a magnetic organizing and attachment device, or holding or binding device, that is used to hold loose sheets or groups of sheets together, in a manner that is not permanent or does not require permanent deformation of the device to remove the sheets or groups of sheets. The present invention is also directed to a holding or binding device that allows the sheets that are held together to be associated/attached with/to a particular page in, for example, a notebook with a spiral binding, or a three ringed binder.

Embodiments of the present invention use magnets in organizing sections. The organizing sections are connected by an intermediate section that is attached to a removable linking device. The magnets of the clipping sections attract the organizing sections together, such that a group of sheets that is place in between the organizing sections is held in place.

The present invention also includes a linking device that can be used to attach the group of sheets to the binding of a notebook or binder. The linking device is structured in such a way that when the holding device is not in use, the linking device can be stored in a compact manner using the magnetic force of the magnets in the organizing sections.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings. However, the accompanying drawings and their exemplary depictions do not in any way limit the scope of the advancements embraced by the present specification. The scope of the advancements embraced by the present specification and drawings is defined by the words of the accompanying claims.

FIGS. 5A-5E illustrate different in use and storage positions according to an exemplary embodiment of the present invention.

DETAILED DESCRIPTION OF THE EMBODIMENTS

Figure 1A:
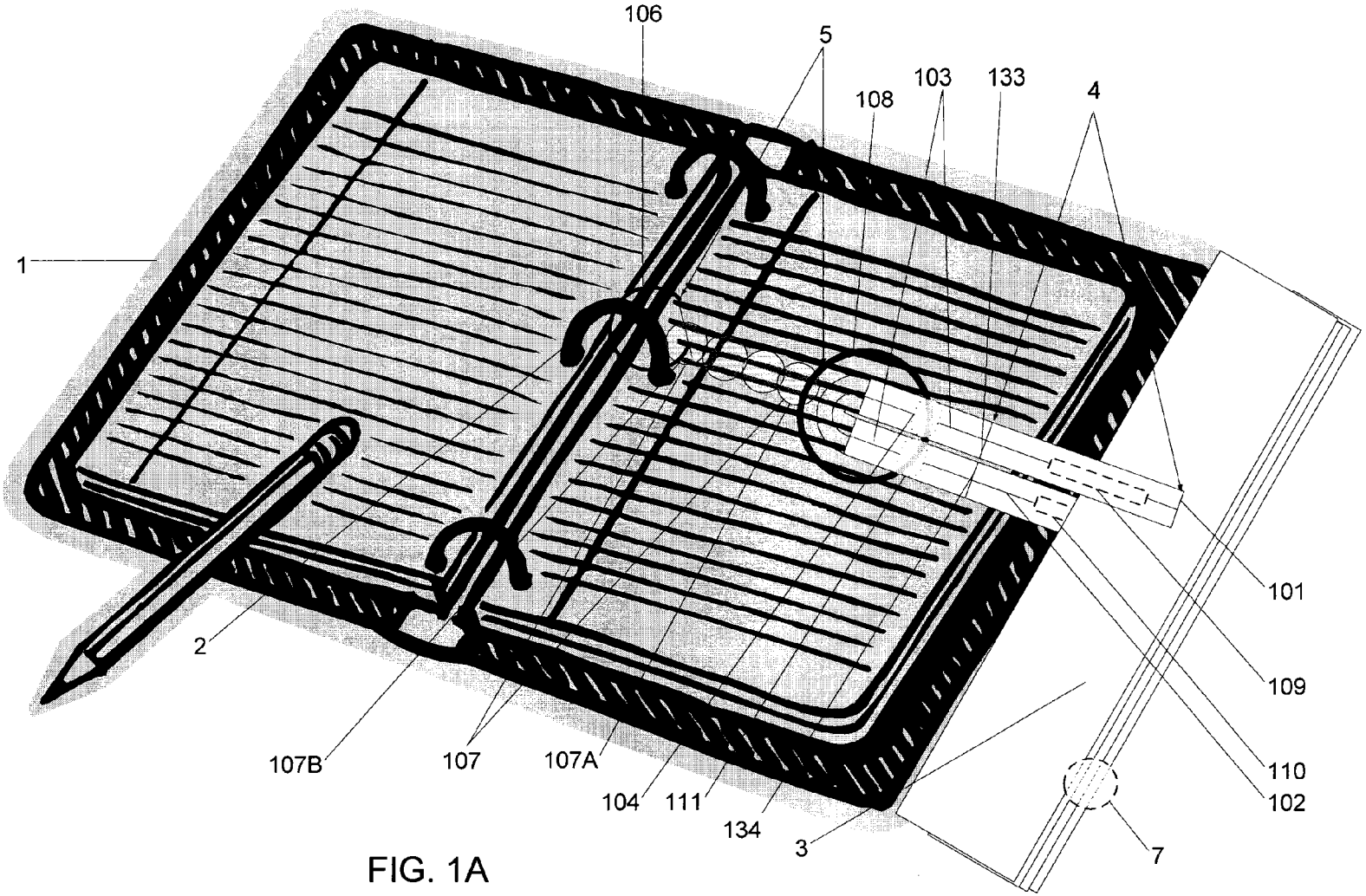
FIGS. 1A and 1B illustrate attachment features of an exemplary embodiment of a magnetic organizing and attachment device of the present invention.

Referring now to the drawings, wherein like reference numerals designate identical or corresponding parts throughout the several views of the organizing and attachment device of the present invention. The following description relates to an organizing and attachment device that includes a first organizing section and a second organizing section. The first organizing section includes a first magnet section, and the second organizing section includes a second magnet section. A connecting section joins the first organizing section and second organizing section, and a linking device is engaged to the connecting section. The linking device includes a linking member with a first linking end, a second linking end, and a fastener. The fastener is connected to one of the first linking end and the second linking end of the linking member. In use, the magnetic force of the first magnet section and the second magnet section cause the first organizing section and the second organizing section to engage opposite sides of an insert comprising several sheets of paper. As a result, the insert is removeably located between the first organizing section and the second organizing section.

The linking device can be arranged in a first, second, third, and fourth position. In the first position, the linking device is not in contact with the first organizing section or the second organizing section. In the second and third positions, the linking device is removeably held in contact with only the first organizing section, and only the second organizing section respectively. Finally in the fourth position, the first organizing section and the second organizing section are inverted. To be in inverted positions, the first organizing section and the organizing holding section are pivoted about a central axis of the connecting section. Thus in the fourth position, the linking device is enclosed between and simultaneously in contact with both the first organizing section and the second organizing section.

FIG. 1A is a view of an open notebook 1 with an organizing and attachment device 100 according to an exemplary embodiment of the present invention. The organizing and attachment device 100 is coupled to a central binding 2 of the notebook 1. An insert 3 is removably held by the organizing and attachment device 100. A fastener 106 of a linking device 5 is coupled to the binding 2 of the notebook 1 and a linking member 107. A first linking end 107A of the linking member 107 is coupled to a connecting section 103 of the organizing and attachment device 100 by an end ring 108 of the linking device 5.

Figure 1B:
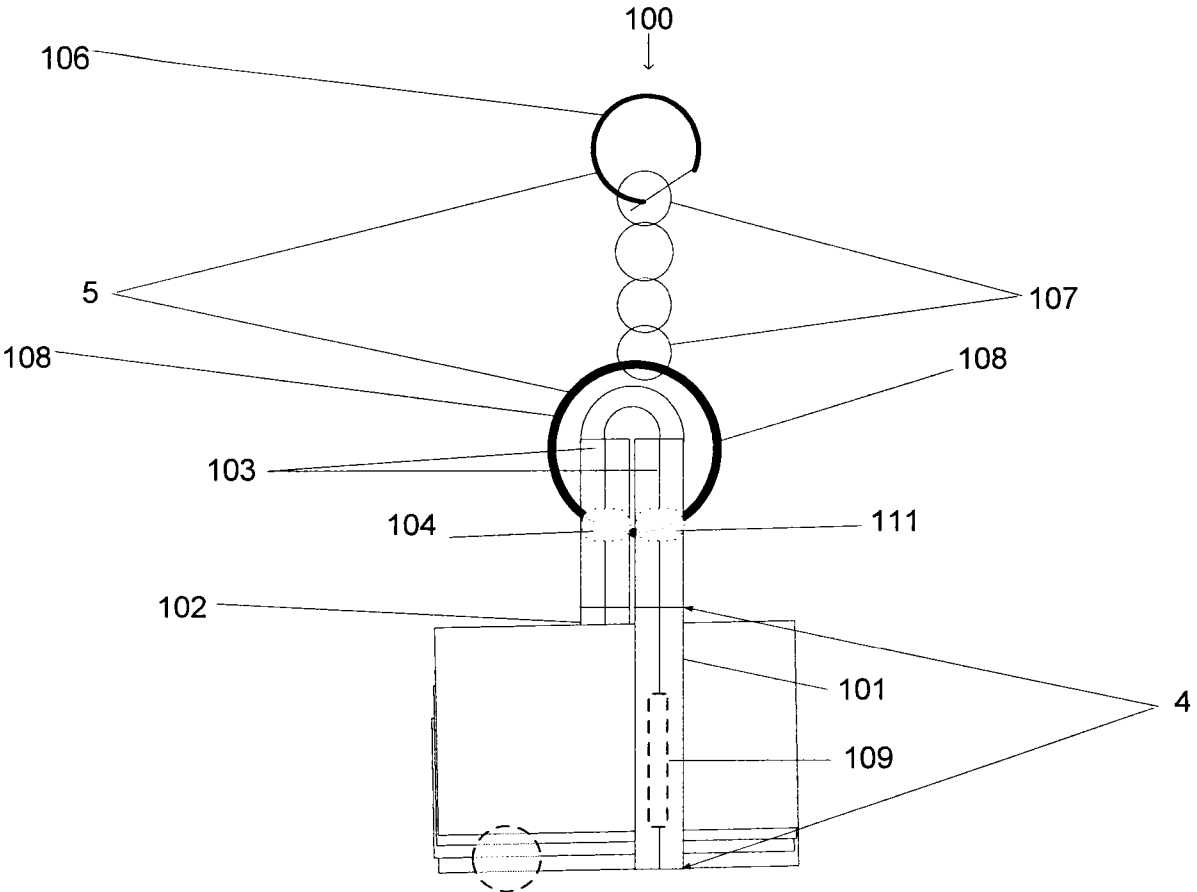
Figure 2:
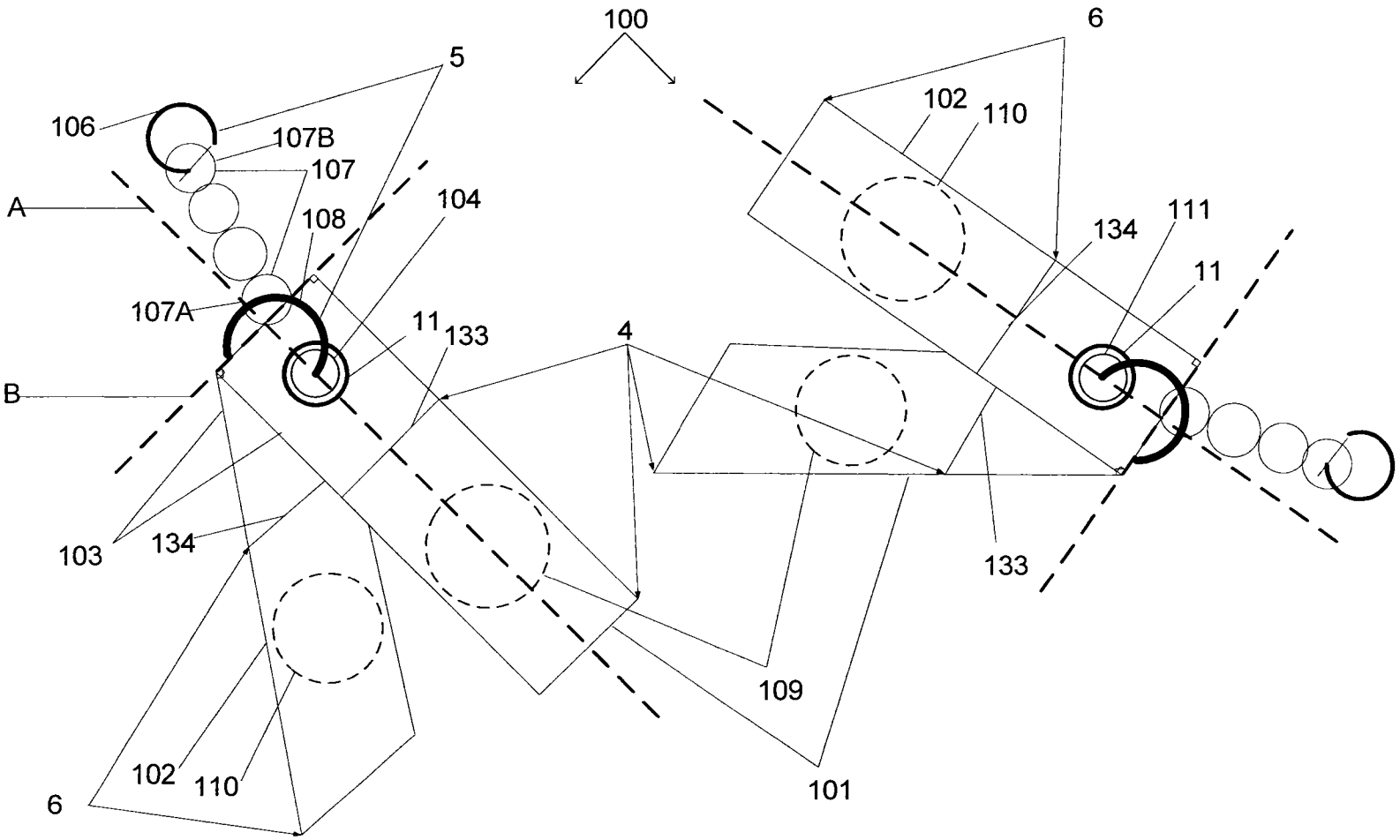
FIG. 2 illustrates a perspective view according to an exemplary embodiment of the present invention.

In FIG. 1A, the organizing and attachment device 100 is shown holding together a group of papers 7 as an insert 3. The papers 7 are held in place by a first magnet section 101 and a second magnet section 102 that is illustrated in FIG. 2. First organizing section 4 and second organizing section 6 are attracted to one another by the magnetic force between a first magnet section 101 and a second magnet section 102. The first 101 and second 102 magnet sections are drawn together such that they hold the papers 7 together as an insert 3 when the papers 7 are positioned in between the first 101 and second 102 magnet sections. Of course, as would be recognized by one of ordinary skill in the art, and in light of the present teachings, any group of items could be held together via the first 101 and second 102 magnet sections. As an example, the organizing and attachment device can also be used to hold a group of business cards 8 as shown in FIG. 1B.

FIG. 2 illustrates the organizing and attachment device 100 of an exemplary embodiment of the present invention disposed in an open position. FIG. 2 contains identifiers identical to those described and illustrated in FIG. 1 and therefore like designations are repeated. The linking device 5 is in a first position, however as illustrated in FIG. 5B, the linking device 5 can be in the first position when the organizing and attachment device 100 is also in a closed position. The connecting section 103 is disposed between the first magnet section 101 and the second magnet section 102.

As illustrated in FIG. 2, one side of the connecting section 103 is connected to a first magnet section end 133 of the first magnet section 101. The side of the connecting section 103 connected to the first magnet section end 133 includes a first hole connection 104 that can receive the end ring 108, first linking end 107A, or fastener 106 of the linking device 5. The other side of the connecting section 103 is connected to a second magnet section end 134 of the second magnet section 102. The side of the connecting section 103 connected to the second magnet section end 134 includes a second hole connection 111 that can receive the end ring 108, linking end 107A, or fastener 106 of the linking device 5.

Figure 3:
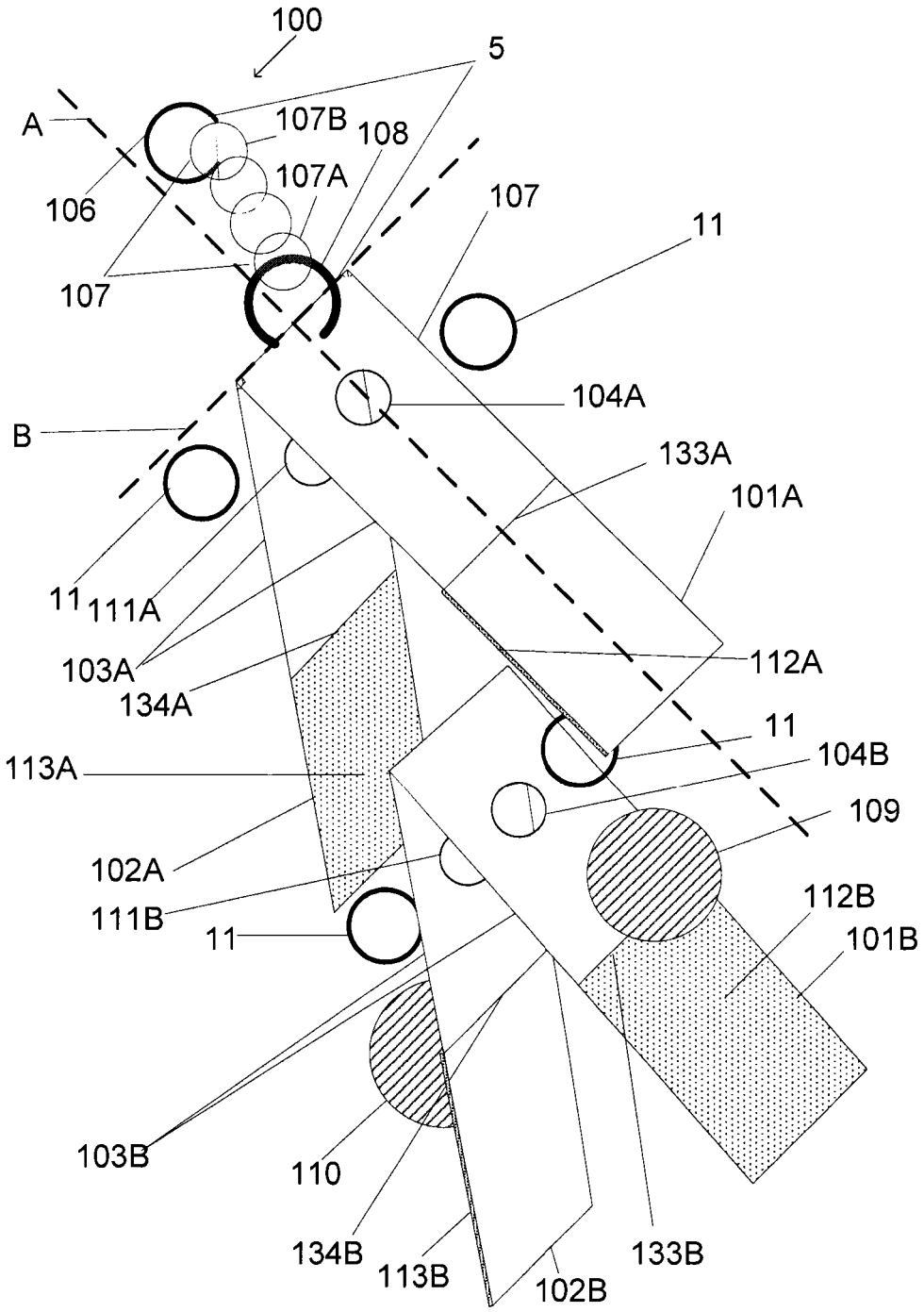
FIG. 3 illustrates an exploded view according to an exemplary embodiment of the present invention.

FIG. 3 illustrates an exploded view of the organizing and attachment device 100 of an exemplary embodiment of the present invention. A first magnet 109 is located between first 101A and second 101B layers of the first magnet section 101. Together, the first magnet 109, and the first 101A and second 101B layers of the first magnet section 101, provide a first organizing section 4. Also illustrated in FIG. 3, a second magnet 110 is located between first 102A and second 102B layers of the second magnet section 102. Together, the second magnet 110, and the first 102A and second 102B layers of the second magnet section 102, provide a second organizing section 6. The first 109 and second 110 magnets may be formed in various sizes and shapes, and be of varying magnetic strengths. It is also contemplated the first 101 and second 102 magnet sections be formed as magnets instead of comprising first and second layers having a magnet there between.

As illustrated in FIG. 3, the first connection hole 104 includes a first hole 104A in a first connection layer 103A. The first connection hole 104 also includes a second hole 104B in a second connection layer 103B. Ring washers (such as eyelets or grommets for example) 11 are clamped or crimped together with the first 103A and second 103B connection layers in between. The ring washers 11 surround the first 104A and second 104B holes of the first connection hole 104. The composition of a second connection hole 111 is the same as the composition of the first connection hole 104 and therefore a further description is omitted.

As illustrated in FIG. 3, each layer (101A, 101B, 102A, and 102B) of each of the magnet sections (101 and 102) includes a binding surface (112A, 112B, 113A, 113B) facing one side of one of the first 109 and second 110 magnets. The binding surface 112A of the first layer 101A of the first magnet section 101 is covered with a layer of adhesive that is coupled to the binding surface 112B of the second layer 101B of the first magnet section 101 and the first magnet 109. The first magnet 109 is enclosed in the first magnet section 101. One or both of the binding surfaces (112A, 112B) may be covered with a layer of adhesive. The adhesive can be any one of a plurality of adhesives as would be recognized by one of ordinary skill in the art. The second magnet section 102 is composed in the same manner as the first magnet section 101 as illustrated in FIG. 3, and therefore a like description is omitted.

The connecting section layers (103A, 103B) can be joined to magnet section ends (133A, 133B, 134A, 134B) by any type of engagement. In the alternative, the first layer 101A of the first magnet section 101, the first layer 103A of the connection section 103, and the first layer 102A of the second magnet section 102 can be formed as a single monolithic flexible strip. The monolithic flexible strip may include a layer of adhesive over an entire surface area of a side that faces the first 109 and second 110 magnets. The second layer 101B of the first magnet section 101, the second layer 103B of the connection section 103, and the second layer 102B of the second magnet section 102 can also be formed as a single monolithic flexible strip.

Figures 4A, 4B:
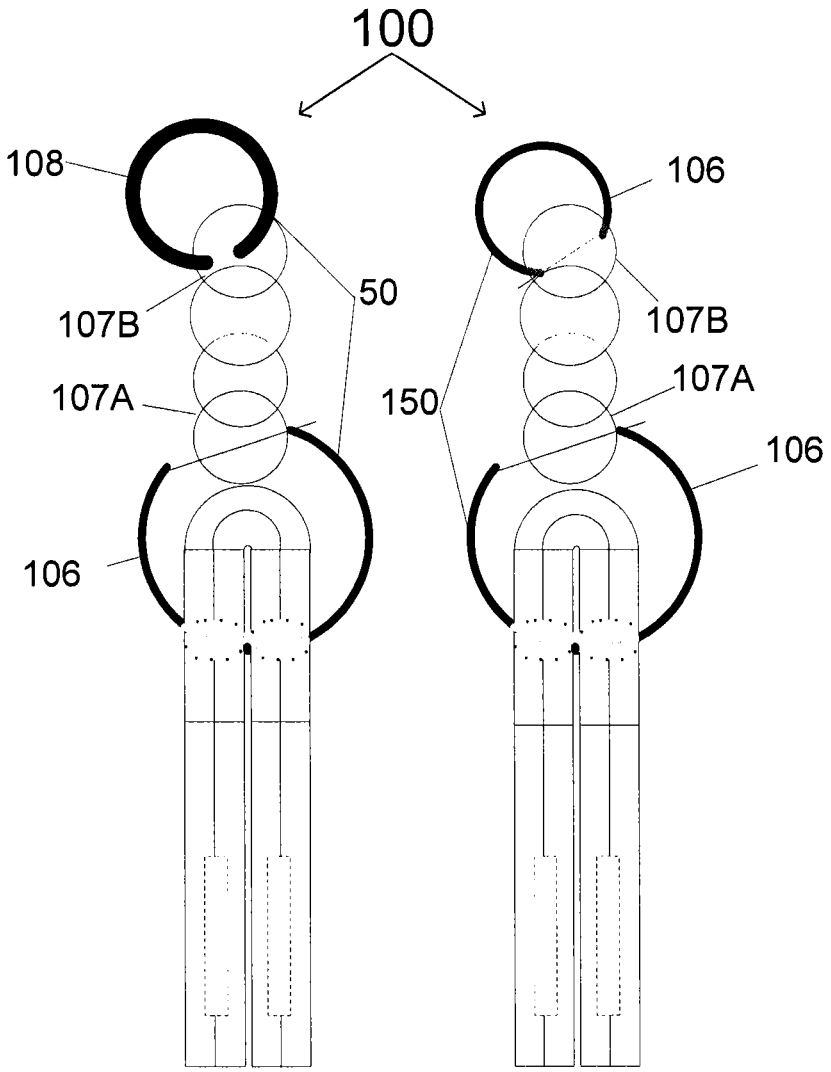
FIGS. 4A-4B illustrate a linking mechanism according to an exemplary embodiment of the present invention

FIG. 4A and FIG. 4B illustrate only an upper portion of an exemplary embodiment of the present invention to show alternative arrangements for the linking member 107, fastener 106, and end ring 108 of the linking device 5.

FIG. 4A illustrates a linking device 50 that includes an arrangement in which the fastener 106 is received by the first 104 and second 111 connection holes and coupled to the first linking end 107A of the linking member 107. The end ring 108 is coupled to a second linking end 107B of the linking member 107.

FIG. 4B illustrates a linking device 150 that includes an arrangement in which the end ring 108 is replaced by another fastener 106. Thus both the first 107A and second 107B linking ends are coupled to a fastener 106. Each fastener 106 can be any type of clasp that permits the fastener 106 to be removably coupled to a linking end, end ring, or connection hole. As a non-limiting example, the fastener may include a spring loaded arm that recoils into a position closing the fastener once a force for opening the fastener is no longer applied.

FIGS. 5A-5E illustrate an exemplary embodiment of the organizing and attachment device 100 of the present invention with the linking device 5 in first, second, third, and fourth positions.

FIGS. 5A and 5B illustrate an exemplary embodiment of the organizing and attachment device 100 of the present invention with the linking device 5 in the first position. In the first position the linking device 5 is held out extended from the connecting section 103. Thus the linking device does not contact either the first 101 or the second 102 magnet sections. A non-limiting example of when the linking device 5 would be in the first position is illustrated in FIG. 1. In FIG. 1, the linking device 5 is extended from the connecting section and the insert is held between the first 4 and second 6 organizing sections, while the fastener 106 is connected to the binding 2 of the notebook 1.

FIG. 5C is representative of second and third positions of the linking device of the an exemplary embodiment of the organizing and attachment device 100 of the present invention. FIG. 5D illustrate an exemplary embodiment of the organizing and attachment device 100 of the present invention with the linking device 5 in the second position. The linking device 5 is attracted by the magnetic force of the first magnet section 101, and held in place on the surface of the first organizing section 4 (in the third position not shown, the linking device 5 would be held in place on the surface of the second organizing section 6). In this position the linking device 5 can be easily deployed once a user decides to use the organizing and attachment device 100 to attach the group of papers 7 (not shown) to the binding 2 (not shown). In addition, with the linking device 5 in the second or third position the organizing attachment device 100 is compact, but can still be used hold the group of papers 7 together while not being attached to the binding 2. Since the linking device 5 is not able to move freely, it will not catch onto other objects that may be near the papers 7 or in a bag where the papers 7 are stored. Thus the group of papers 7 can be transported from one bag to another bag or location, without complication.

FIG. 5E shows an exemplary embodiment of the organizing and attachment device 100 of the present invention with the linking device 5 in a fourth position. In the fourth position the first 4 and second 6 organizing sections are disposed in inverted positions. Each organizing section is inverted by being pivoted 180° about the central axis B of the connecting section 103 to close around the linking device 5 so that the linking device 5 is completely enclosed. The total length of the linking device 5, in any configuration such as those illustrated in FIGS. 4A-4B, is less than the combined length of the first organizing section 4 and the side of the connecting section 103 connected to the first magnet section end 133. Likewise the total length of the linking device 5, in any configuration such as those illustrated in FIGS. 4A-4B, is less than the combined length of the second organizing section 6 and the side of the connecting section 103 connected to the second magnet section end 134.

One advantage of putting the organizing and attachment device 100 in the fourth position is that the organizing and attachment device 100 becomes more compact and easy to place in a small area such as a pocket of a bag. The ability to put the linking device 5 in the fourth position also provides for a more robust organizing and attachment device 100. In the fourth position the linking device 5 is protected within the connecting section 103 and the first 4 and second 6 organizing sections. This prevents wear or other damage that may arise when the organizing and attachment device 100 is not in use.

Figure 6:
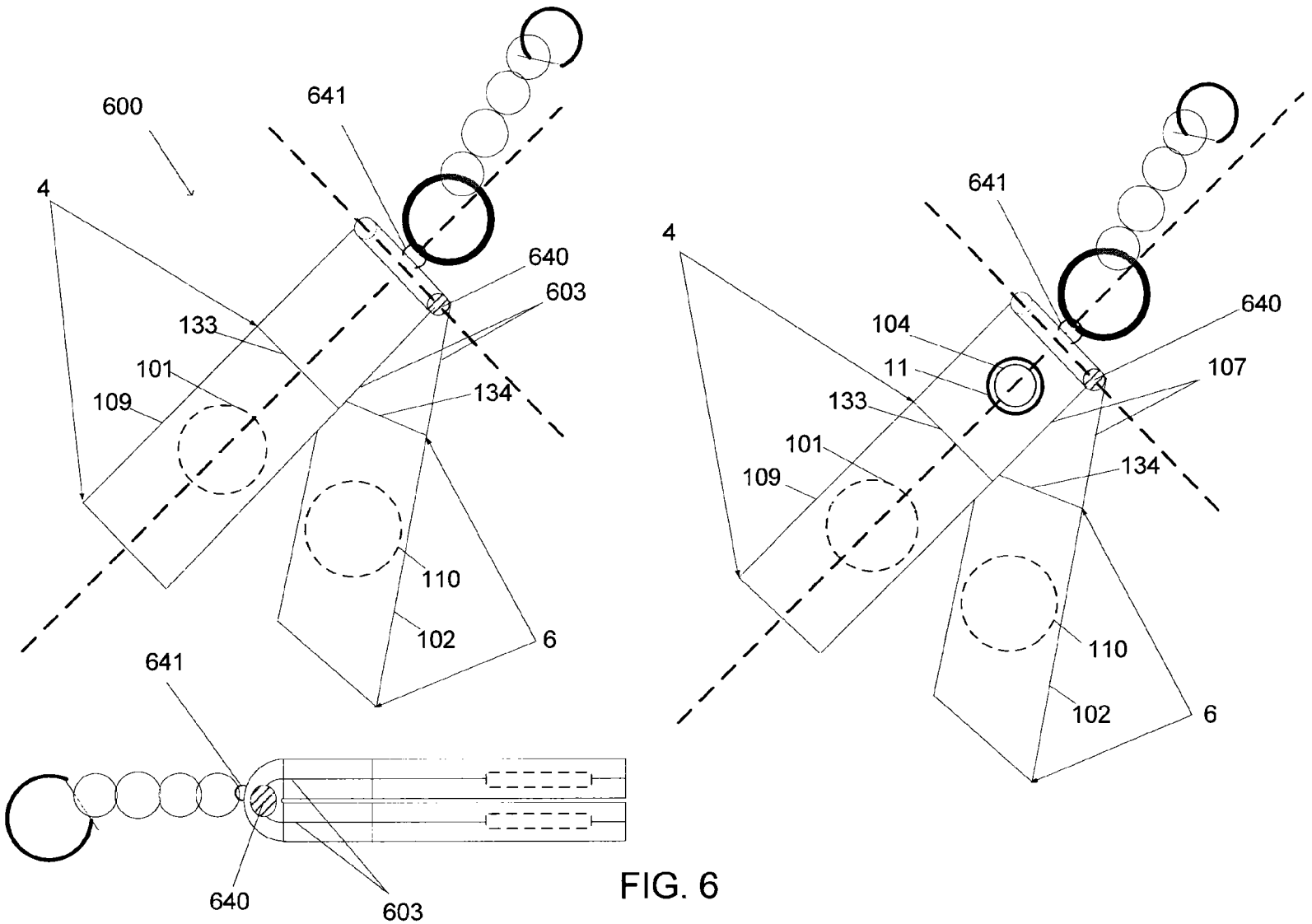
FIG. 6 illustrates a first modification to a connection section according to an exemplary embodiment of the present invention.

FIG. 6 illustrates a modification to a connection section of an exemplary embodiment of the present invention. FIG. 6 contains identifiers identical to those described and illustrated in FIGS. 1 and 2, and therefore like designations are repeated. FIG. 6 illustrates an organizing and attachment device 600 that includes a connecting section 603 that includes a support bar 640 provided in place of connection holes. The support bar 640 may include a ring extender 641 that extends through one layer of the connecting section 603 along a central axis B of the connecting section 603. The ring extender 641 can be coupled to the fastener 106 or end ring 108 of the linking device 5. It is also possible that both the connection holes (104, 110) and the support bar 640 could be provided in another version of an organizing and attachment device of the present invention.

Figure 7:
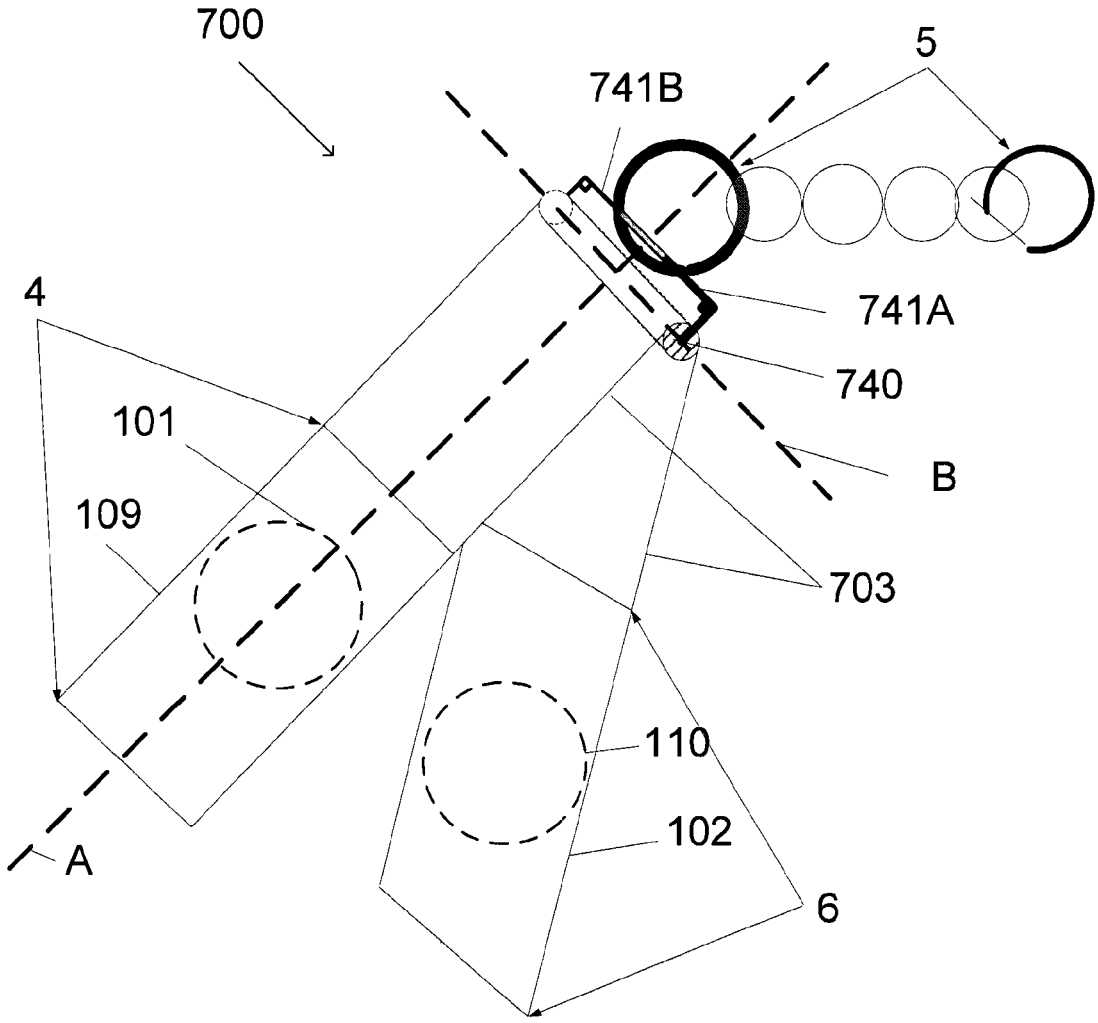
FIG. 7 illustrates a second modification to a connection section according to an exemplary embodiment of the present invention.

FIG. 7 illustrates another modification to a connection section of an exemplary embodiment of the present invention. FIG. 7 contains identifiers identical to those described and illustrated in FIGS. 1 and 2, and therefore like designations are repeated. FIG. 7 illustrates an organizing and attachment device 700 that includes a connecting section 703 that includes a support bar 740 that includes a first arm 741A and a second arm 741B extending from opposite ends of the support bar 704. Each arm (741A, 741B) extends from an end of the support bar 740 it is attached to, towards an opposite end of the support bar 740 along an axis parallel to the central axis B of the connecting section 703. The central axis B is perpendicular to the longitudinal axis A of the organizing and attachment device 700. A portion of arm 741A overlaps at least a portion of arm 741B. The overlapping portions can be pressed against one another such that arms 741A and 741B can be spread apart to provide a gap.

In FIG. 7 the linking device 5 is illustrated, however the organizing and attachment device 700 can be attached to the binding 2 of the notebook 1 without the linking device 5. One of ordinary skill in the art would recognize that the connecting section 703 can serve alone as a linking device. The binding 2 of the notebook 1 or the linking device 5 can slide in the gap between the arms 741A and 741B. Once the binding 2 or linking device 5 has been slid through the gap, the arms 741A and 741B elastically move back into pressing contact. This provides a simple and easy way for a user to attach the organizing and attachment device 700 to the binding 2, the linking device 5, or other object. In another version of the organizing and attachment device 700, the overlapping portions can also be provided with a small gap such that the arms 741A and 741B do not have to be spread apart to receive a binding 2. The gap is small enough that the binding 2 or the linking device 5 remains between the connecting section 703 and the arms 741A and 741B if the notebook 1 is moved.

As discussed above the linking device 5, such as those illustrated in FIGS. 1-3 and 4A-4B, can be attached to the connecting section 703 of the organizing and attachment device 700. The linking device 5 can be attached by sliding the fastener 106, linking member end 107A, or end ring 108 between the arms 741A and 741B. In addition the fastener 106 could be opened to receive the arms 741A and 741B, and then closed. In this arrangement the length of the linking member 107 is provided such that the linking device 5 and the arms 741A and 741B are completely enclosed when the first 4 and second 6 organizing sections are inverted and the linking device 5 is in the fourth position.

Figure 8:
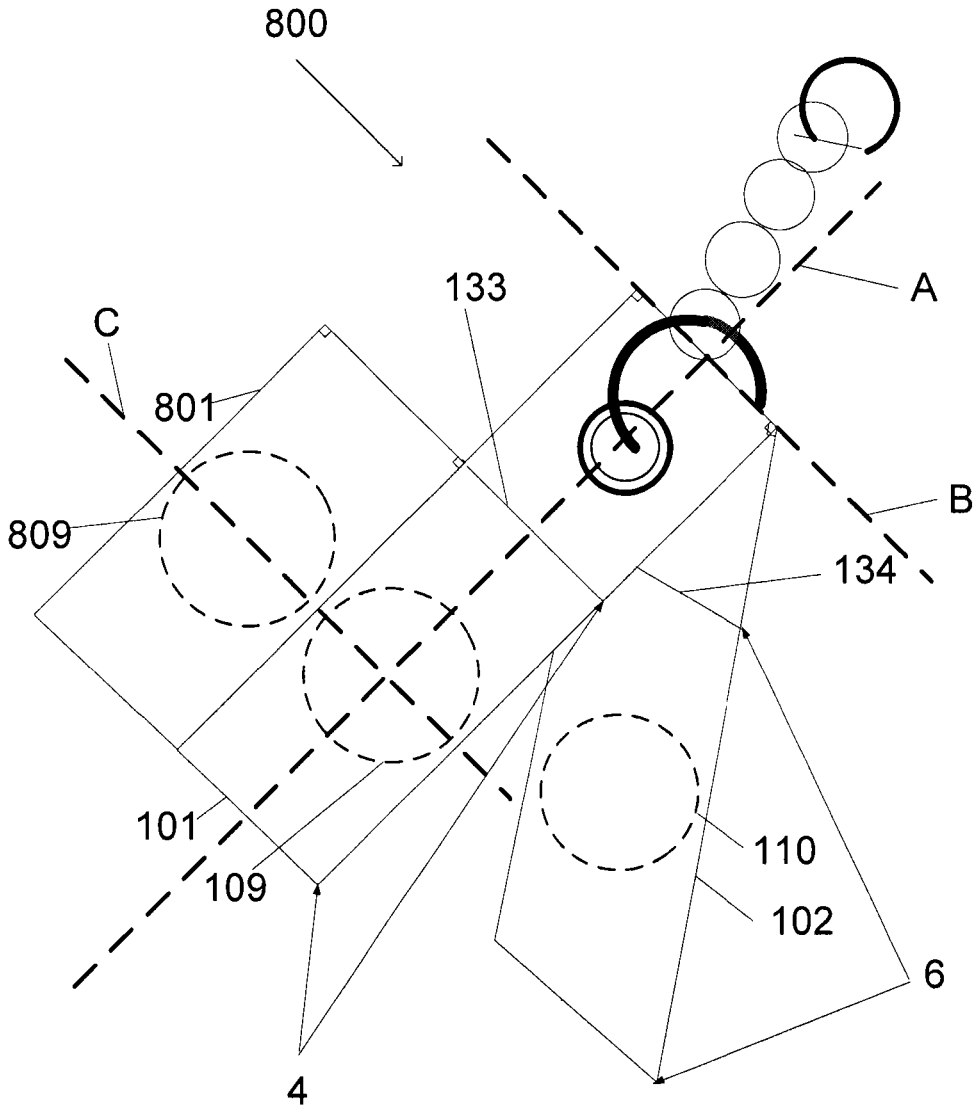
FIG. 8 illustrates a first modification to the organizing sections of an exemplary embodiment of the present invention.

FIG. 8 illustrates a modification to the organizing sections of an exemplary embodiment of the present invention. FIG. 8 contains identifiers identical to those described and illustrated in FIGS. 1 and 2, and therefore like designations are repeated. FIG. 8 illustrates an organizing and attachment device 800 that includes at least one additional magnet section 801. The third magnet section 801 of the organizing and attachment device 800 extends from the first magnet section 101 along an axis C that is perpendicular to the longitudinal axis A of the first magnet section 101. The third magnet section 801 includes a magnet 809 disposed between two layers. The third magnet section 801 can be used to hold a group of papers 7 in place along the vertical axis of the notebook 1 by extending over a top edge on the note book 1 from one side of the group of papers 7. The third magnet section 801 can pivot around the top edge of the notebook 1 so that it faces the first magnet section 101 which it extends from. The third magnet section 801 can stay in one position on the outside of the notebook 1 due to the magnetic force of its magnet 809 and the magnet 109 of the first magnet section 109. Thus the third magnet section 801 provides a greater degree of stability when organizing a large group of papers because the movement of the papers and the attachment and organizing device 800 is limited.

It is also contemplated that that a fourth magnet section is provided extending from the second magnet section 102 in the same manner as the third magnet section 801 that extends from the first magnet section 101.

Figure 9:
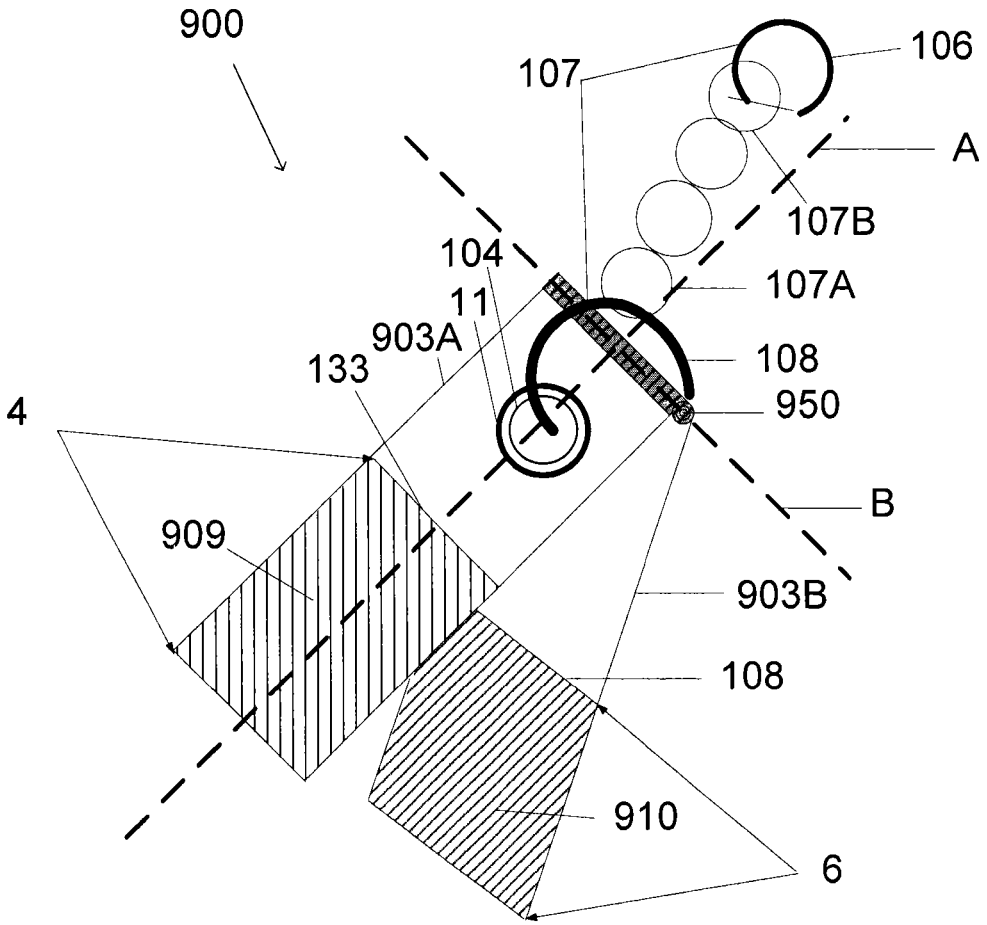
FIG. 9 illustrates a second modification to the organizing sections of an exemplary embodiment of the present invention.

FIG. 9 illustrates a modification to organizing sections of an exemplary embodiment of the present invention. FIG. 9 contains identifiers identical to those described and illustrated in FIGS. 1 and 2, and therefore like designations are repeated. The organizing and attachment device 900 includes first 4 and second 6 organizing sections in which the first magnet section 101 is formed from a first magnet 909. The second magnet section 102 is formed from a second magnet 910. The first 101 and second 102 magnet sections are joined together by first 903A and second 903B extensions at a hinge 950 of a hinged connecting section 903. The first extension 903A is connected to the first magnet section end 133, and the second extension 903B is connected to the second magnet section end 134. The first extension 903A includes connection hole 104 which can receive the fastener 106, linking member end 107A, or end ring 108 of the linking device 5. The second extension 903B includes connection hole 111 which can receive the fastener 106, linking member end 107A, or end ring 108 of the linking device 5. In the alternative the first 101 and second 102 magnet sections include first 104 and second 111 hole connections and are directly engaged to one another by the hinge 950. Thus the extensions (903A and 903B) are not provided.

The present invention provides a magnetic organizing and attachment device that can be conveniently used to hold together items such as loose papers or groups of papers, which can then be attached to a notebook, binder, or other object. The present invention provides several advantages because it does not have to be deformed to be removed, does not mark or damages the items it holds, is very durable, and can be reused. The present invention also includes a linking device that can be arranged in several different positions that each offer advantages. One position allows the present invention to be attached to a binder, notebook, or other objects. Another position enables the present invention to be easily stored, used to group items together when the linking device is not deployed, or the linking device to be easily deployed from a stored position. In another position the present invention is moved into a compact arrangement that protects the linking device when the present invention is not in use.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. An apparatus for detachably holding an insert, the apparatus comprising:

a first section that includes at least one first magnet section;

a second section that includes at least one second magnet section;

a connecting section joining the first section and the second section;

a linking device engaged with the connecting section and including a linking member with a first end, a second end, and a first fastener connected to at least one of the first end and the second end of the linking member, wherein the linking device has a first position, a second position, a third position, and a fourth position, wherein in the first position, the linking device is not in contact with the first section and the second section, in the second position, the linking device is removeably held in contact with the first section, in the third position, the linking device is removeably held in contact with the second section, and in the fourth position, the first section and the second section are inverted about a central axis of the connecting section such that the linking device is enclosed between and simultaneously in contact with the first section and the second section, and wherein the at least first magnet section and the at least second magnet section engage the first section and the second section to opposite sides of the insert such that the insert is removeably located between the first section and the second section.

2. The apparatus of claim 1, wherein the first section includes a first layer and a second layer, and the at least one first magnet section is disposed between the first layer and the second layer of the first section, and the second section includes a first layer and a second layer, and the at least one second magnet section is disposed between the first layer and the second layer of the second section.

3. The apparatus of claim 2, wherein the connecting section includes a first layer and a second layer, wherein the first layer is flexible, and the second layer is flexible.

4. The apparatus of claim 3, wherein the connecting section includes at least one engagement hole that receives at least one of the first end of the linking member, the second end of the linking member, and the first fastener.

5. The apparatus of claim 4, wherein the connecting section is connected to the first end of the linking member, and the first fastener is disposed at the second end of the linking member and has a clasp to connect the first fastener to an extrinsic object.

6. The apparatus of claim 4, wherein a length of the linking device is less than a total length of a first portion of the connecting section and the first section when the first section and the second section are inverted, and the length of the linking device is less than a total length of a second portion of the connecting section and the second section when the first section and the second section are inverted.

7. The apparatus of claim 4, wherein the at least one engagement hole receives the first fastener, the first fastener is connected to the first end of the linking member, the second end of the linking member is connected to a second fastener and the second fastener connects the apparatus to an extrinsic object.

8. The apparatus of claim 2, wherein the connecting section includes at least one engagement hole that receives at least one of the first end of the linking member, the second end of the linking member, and the first fastener, the at least one first magnet section extends from a first end of the connecting section to form the first section, and the at least one second magnet section extends from a second end of the connecting section to form the second section.

9. The apparatus of claim 8, wherein the connecting section includes a hinge connected to first end of the connecting section and the second end of the connecting section.

10. The apparatus of claim 2, further comprising:

a third section that includes at least a third magnet section, wherein the third section is attached to the first section and extends along a plane that is perpendicular to a longitudinal axis of the first section.

11. The apparatus of claim 10, wherein the third section extends from the first section between the connecting section and an end of the first section.

12. The apparatus of claim 10 further comprising:

a fourth section that includes at least a fourth magnet section, wherein the fourth section is attached to the second section and extends along a plane that is perpendicular to a longitudinal axis of the second section.

13. The apparatus of claim 12, wherein the third section extends from the first section between the connecting section and an end of the first section, and the fourth section extends from the second section between the connecting section and an end of the second section.

14. The apparatus of claim 12, wherein the third section includes a first layer and a second layer, and the at least third magnet section is disposed between the first layer and second layer of the third section; and the fourth section includes a first layer and a second layer, and the at least fourth magnet section is disposed between the first layer and second layer of the fourth section.

15. The apparatus of claim 1, wherein the first section, the second section, and the connecting section include a first layer and a second layer, the first layer of the first section, the second section, and the connection section are formed by a first monolithic strip, and the second layer of the first section, the second section, and the connection section are formed by a second monolithic strip.

16. The apparatus of claim 15, wherein the first and second monolithic strips are flexible.

17. The apparatus of claim 15, wherein the first monolithic strip is a flexible strip provided with an adhesive on at least one side, and the second monolithic strip is a flexible strip provided with an adhesive on at least one side.

18. The apparatus of claim 15, wherein the connecting section includes at least one engagement hole that receives at least one of the first end of the linking member, the second end of the linking member, and the first fastener.

19. The apparatus of claim 1, further comprising:

a second fastener, wherein the first fastener is disposed on the first end of the linking member and the second fastener is disposed on the second end of the linking member.

20. The apparatus of claim 19, wherein the linking member can be detached from the first fastener and the second fastener.

* * * * *